US006510297B2

(12) United States Patent
Kawai et al.

(10) Patent No.: US 6,510,297 B2
(45) Date of Patent: Jan. 21, 2003

(54) TONER DENSITY SENSOR

(75) Inventors: Noboru Kawai, Nabari (JP); Shinya Kawanishi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/888,497

(22) Filed: Jun. 26, 2001

(65) Prior Publication Data

US 2002/0001479 A1 Jan. 3, 2002

(30) Foreign Application Priority Data

Jun. 26, 2000 (JP) ..... 2000-191586

(51) Int. Cl.[7] ..... G03G 15/08

(52) U.S. Cl. ..... 399/74; 356/445; 399/44; 399/60

(58) Field of Search ..... 399/74, 60, 64, 399/44; 250/338.1, 339.11; 356/445, 448

(56) References Cited

U.S. PATENT DOCUMENTS 4,801,980 A * 1/1989 Arai et al. ..... 399/74 X
4,833,506 A * 5/1989 Kuru et al. ..... 399/60 X
5,325,153 A * 6/1994 Mitsuse et al. ..... 399/74
5,365,313 A * 11/1994 Nagamochi et al. .... 356/445 X

FOREIGN PATENT DOCUMENTS

JP A9-89769 4/1997
JP A10-186827 7/1998

* cited by examiner

*Primary Examiner*—Sophia S. Chen
(74) *Attorney, Agent, or Firm*—Birch, Stewart, Kolasch & Birch, LLP

(57) ABSTRACT

An object of the invention is to provide a toner density sensor capable of detecting toner density with high accuracy without being affected by the temperature change. A light-emitting diode emits infrared light toward the toner attached to the surface of a photosensitive drum, and the infrared light reflected from the toner is received by a photodiode. An amplifier circuit for detecting color toner density and an amplifier circuit for detecting black toner density, of which both amplify outputs from the photodiode, each employ a thermister for the feedback resistance of the amplifier. An input resistance in the amplifier circuit and the thermister adjust the gain of the amplifier circuit so as to obtain optimal outputs.

2 Claims, 6 Drawing Sheets

(NOTE. 1) TEMPERATURE CHARACTERISTICS OF THERMISTER WITH RESPECT TO OUTPUT VOLTAGE OF AMPLIFIER CIRCUIT (NOTE. 2) TEMPERATURE CHARACTERISTICS OF THERMISTER WITH RESPECT TO OUTPUT VOLTAGE OF AMPLIFIER CIRCUIT

TONER DENSITY SENSOR

BACKGROUND OF THE INVENTION

1. Field of the Invention

The present invention relates to a toner density sensor for detecting toner density required for image formation suitable for use in color image formation apparatuses, such as color copiers, color printers, or the like.

2. Description of the Related Art

In color image formation apparatuses, such as color copiers, color printers, or the like, a color image is formed by selectively attaching color toner of three colors: yellow, magenta, and cyan to an electrostatic latent image formed on a photoconductor, and the resultant color image is transferred onto a paper sheet or the like. Although the use of such three-color toner allows reproduction of every color including black, to display a black color as vivid as possible, black toner has come to be used in addition to the three-color toner.

Moreover, to achieve satisfactory color reproduction, a toner density sensor is used that detects the density of the toner attached to the photoconductor.

FIGS. 6A and 6B are circuit diagrams illustrating a conventional toner density sensor. The toner density sensor is composed of a light-receiving portion shown in FIG. 6A, and a light-emitting portion and a constant-voltage circuit shown in FIG. 6B. The light-emitting portion is composed of a light-emitting diode LED1 and an LED driving circuit 10. The constant-voltage circuit is composed of condensers C1 and C2, resistances R5, R6, and R7, amplifiers IC5 and IC6, and a regulator REG1.

In the light-emitting portion, after application of power source voltage Vcc, the LED driving circuit 10 drives the light-emitting diode LED1 to emit infrared light. The regulator REG1 and the condensers C1 and C2 are employed to stabilize the circuit, and adjust the resistance values of the resistances R5, R6, and R7 so that the amplifiers IC5 and IC6 output optimal reference voltages Vref1 and Vref2. The light-receiving portion includes a photodiode PD1, a variable resistance VR1, resistances R1, R2, R3, R4, R8, R9, R10, R11, and R12, and amplifiers IC1, IC2, and IC4.

The photodiode PD1 receives light, such as infrared light, and then a voltage is outputted by an I/V (current-voltage) converter constituted by the amplifier IC1 and the variable resistance VR1 and the resistance R12. The output voltage is inputted through the input resistances R2 and R4 to the negative terminals of the amplifiers IC2 and IC4, respectively. The amplifiers IC2 and IC4 have their positive terminals connected to the resistances R8 and R10, respectively, which receive Vref2 and Vref1, respectively. An output of the respective amplifiers IC2 and IC4 is fed back to the negative terminals of the amplifiers IC2 and IC4 through the negative feedback resistances R1 and R3, respectively. At this time, the gain of the amplifier circuit is expressed as R1/R2 and R3/R4.

The light such as infrared light, emitted from the light-emitting diode LED1 of the light-emitting portion is irradiated onto the toner attached to the photoconductor, and is reflected from the toner and the surface of the photoconductor. The resultant reflection light is received by the photodiode PD1 of the light-receiving portion. The photodiode PD1 outputs a current in accordance with the amount of received light, and, in the light-receiving portion, the output current is converted into a voltage by the I/V converter and is then amplified by the amplifier circuit before being outputted. Based on this voltage, the density of the toner attached to the photoconductor is detected.

There is a difference between the amount of variation in output currents for toner density obtained as a result of the detection of color toner density and the amount of variation in output currents for toner density obtained as a result of the detection of black toner density. Therefore, the output current fed from the light-receiving element is, after being converted into a voltage by the I/V conversion circuit provided inside the light-receiving portion, amplified by the amplifier circuit so as to set each variation amount at a predetermined value.

In the toner density sensor disclosed in Japanese Unexamined Patent Publication JP-A 9-89769 (1997), the light-receiving element is arranged in an appropriate position so as not to receive specular reflection light from the surface of the photoconductor. This eliminates the influence of specular reflection light and thus makes it possible to achieve wide-range, highly-accurate detection of color toner density.

The light-emitting diode, the photodiode, and the periphery circuit each have temperature characteristics. As seen from FIGS. 4 and 5 showing temperature characteristics graphs, a voltage to be outputted varies with changes in temperature. FIGS. 4 and 5 are graphs showing temperature characteristics in which the ordinate axis indicates output voltages and the abscissa axis indicates temperature. As the primary temperature characteristics (as observed before compensation), output voltages are high on the lower-temperature side and are low on the higher-temperature side.

Accordingly, even if the amount of received light is kept at a constant level, a variation in output voltage occurs if a temperature change occurs. This makes it impossible to detect toner density with accuracy.

SUMMARY OF THE INVENTION

It is an object of the invention to provide a toner density sensor capable of detecting toner density with high accuracy without being affected by a temperature change.

The invention provides a toner density sensor which detects density of toner attached to a photoconductor of an electrophotographic color image forming apparatus based on an output level in accordance with an amount of reflection light of irradiation light irradiated toward the photoconductor, the toner density sensor comprising:

a light-receiving element for receiving reflection light;

an amplifier circuit for amplifying output from the light-receiving element; and compensation means disposed in the amplifier circuit, for compensating for variation in output level due to a temperature change.

According to the invention, the amplifier circuit for amplifying an output from the light-receiving element includes compensation means for compensating for variation in output level due to a temperature change. This makes it possible to detect toner density with high accuracy without being affected by the temperature change.

In the invention, it is preferable that the compensation means is composed of an input resistance in the amplifier circuit and a negative feedback resistance constituted by a thermistor.

According to the invention, the compensation means is composed of an input resistance in the amplifier circuit and a negative feedback resistance constituted by a thermistor. Therefore, by properly adjusting the value of each resistance, optimal output levels can be attained.

In the invention, it is preferable that an amplifier circuit for detecting color toner density and an amplifier circuit for detecting black toner density are each provided with the compensation means.

According to the invention, an amplifier circuit for detecting color toner density and an amplifier circuit for detecting black toner density are each provided with compensation means. This makes it possible to detect the density of toner, regardless of whether it is color or black toner, with high accuracy without being affected by the temperature change.

According to the invention, by providing a thermistor in each of the amplifier circuit for detecting color toner density and the amplifier circuit for detecting black toner density, of which both amplify outputs from the photodiode, variation in output voltages due to the temperature change can be successfully compensated for. This makes it possible to detect the density of the color or black toner attached to the surface of a photoconductor with high stability and accuracy. Accordingly, a color image forming apparatus in which the toner density sensor embodying the invention is employed is capable of forming an image close to that printed on an original document.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
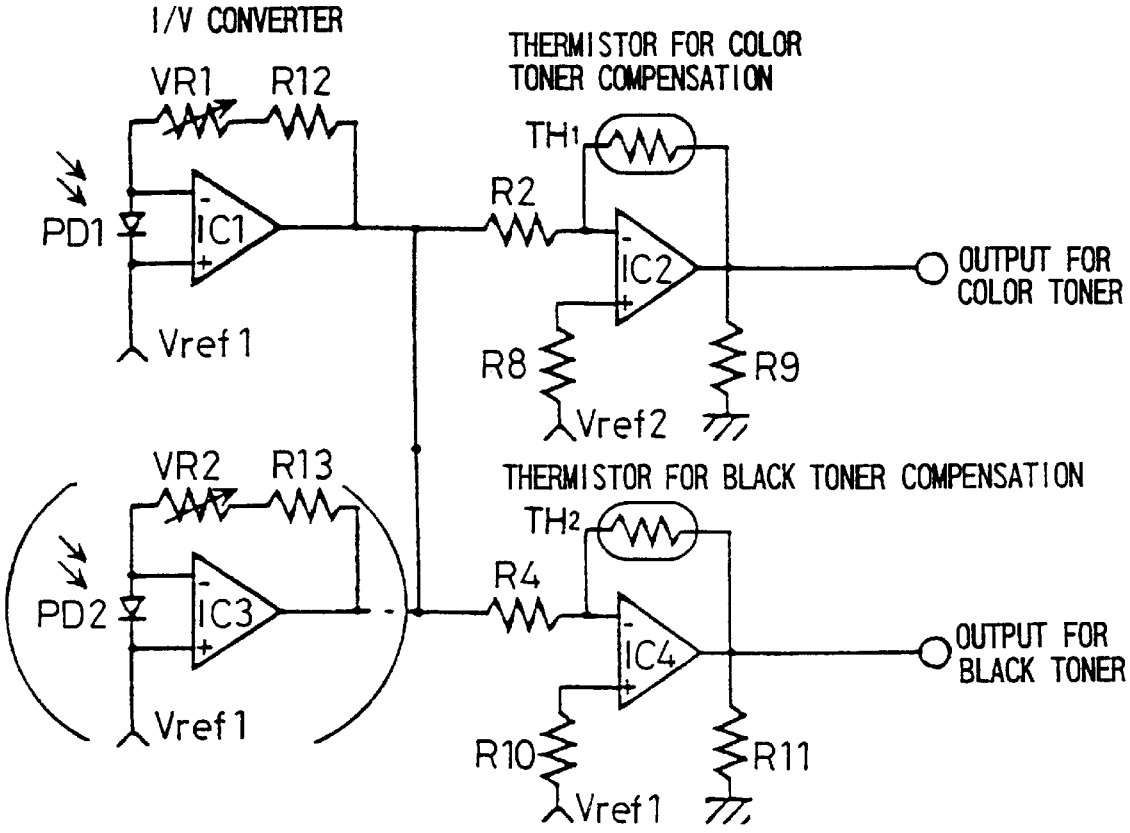
FIGS. 1A and 1B are circuit diagrams illustrating the toner density sensor of an embodiment of the invention.

Now referring to the drawings, preferred embodiments of the invention are described below.

Figure 1B:
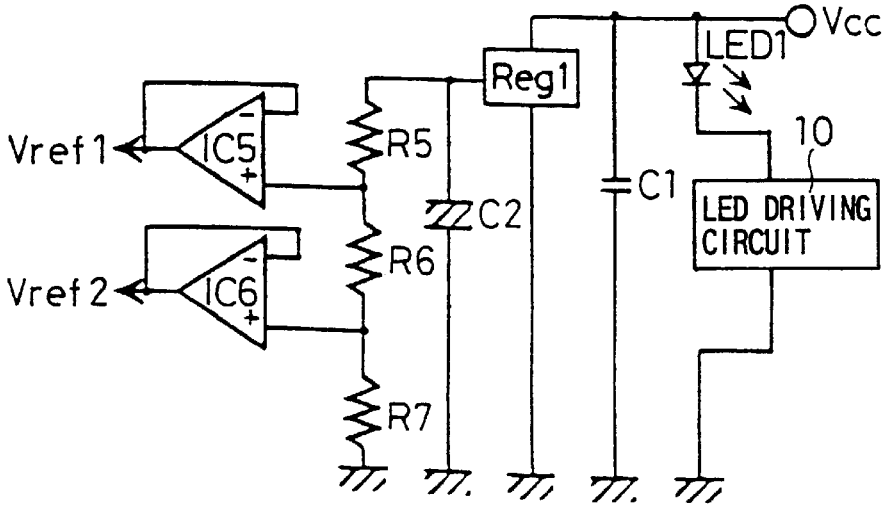

FIGS. 1A and 1B are circuit diagrams illustrating the toner density sensor of an embodiment of the invention.

Figure 6A:
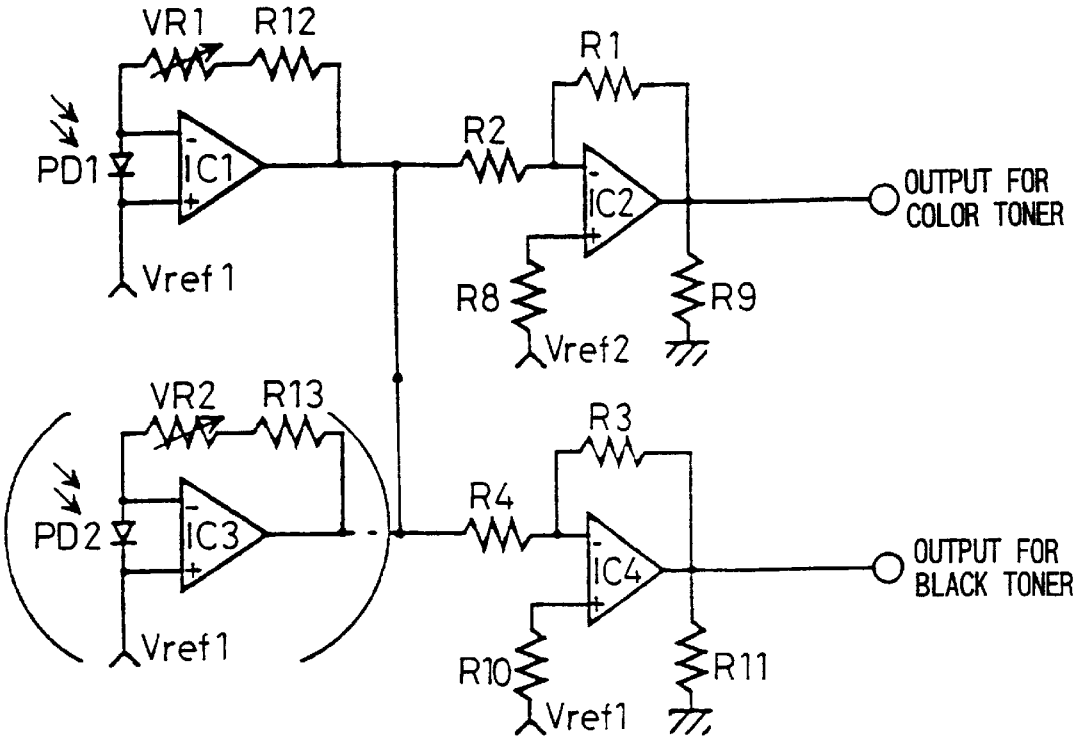
FIG. 6A Prior Art
FIGS. 6A and 6B are circuit diagrams illustrating a conventional toner density sensor.
Figure 6B:
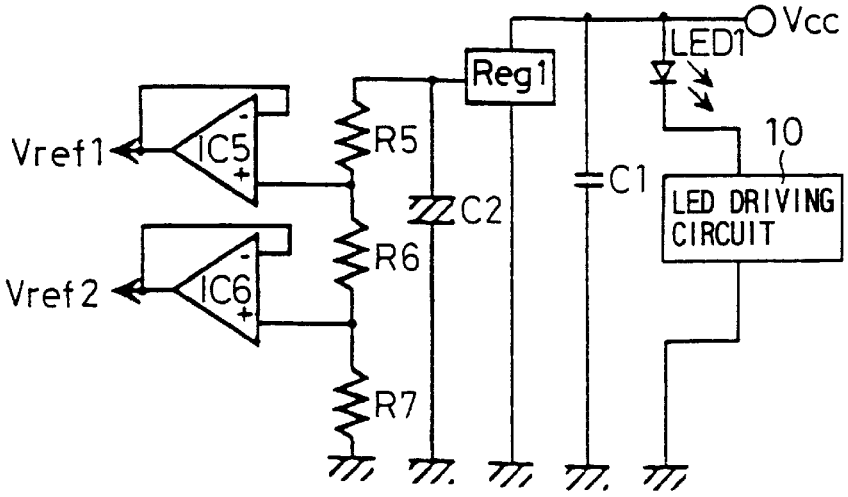
FIG. 6B Prior Art

The toner density sensor is composed of a light-receiving portion shown in FIG. 1A, and a light-emitting portion and a constant-voltage circuit as shown in FIG. 1B. The light-emitting portion and the constant-voltage circuit as shown in FIG. 1B have the same circuit configurations as those shown in FIG. 6B described previously, and thus a description therefor is omitted.

The light-receiving portion includes a photodiode PD1 acting as a light-receiving element, thermistors TH1 and TH2, a variable resistance VR1, resistances R2, R4, R8, R9, R10, R11, and R12, and amplifiers IC1, IC2, and IC4.

The light, such as infrared light, emitted from a light-emitting diode LED1 is reflected from the toner attached to a photoconductor, and the resultant reflection light is received by the photodiode PD1 acting as a light-receiving element. Thereafter, a voltage is outputted from an I/V (current-voltage) converter consisting of the variable resistance VR1 and the resistance R12. The output voltage is amplified by a subsequently-described amplifier circuit before being outputted. The output voltage fed from the I/V converter is inputted through the input resistances R2 and R4 to the negative terminals of the amplifiers IC2 and IC4, respectively. The amplifiers IC2 and IC4 have their positive terminals connected to the resistances R8 and R10, respectively, which receive Vref2 and Vref1, respectively. On the output side of each amplifier, the thermistors TH1 and TH2 are used as negative feedback resistances to achieve feedback for the negative terminals of the amplifiers IC2 and IC4. As described earlier, in the conventional toner density sensor, output voltages are high on the lower-temperature side and are low on the higher-temperature side. To compensate for such a difference, a thermistor having a positive property is used in this embodiment. Moreover, at this time, since the gain of the amplifier circuit is expressed as TH1/R2 or TH2/R4, by adjusting properly the resistance values of the input resistance and the negative feedback resistance realized by using a thermistor, of which both serve as compensation means, optimal output voltages can be attained. The temperature coefficient of the thermistor actually used in the embodiment is set at 3000 ppm/°C.

The light received by the photodiode PD1 is converted into a voltage by the first-stage circuit, i.e., the I/V converting circuit, and is thereafter outputted to the second-stage circuit, i.e., the amplifier circuit. The amplifier circuit is provided with an amplifier circuit for detecting color toner density and an amplifier circuit for detecting black toner density. The voltage outputted from the I/V converting circuit is amplified by the amplifier circuit so as to be outputted at the desired output level. The reference voltages Vref1 and Vref2 are so set as to be outputted at the optimal detection and operation levels, respectively.

Figure 2A:
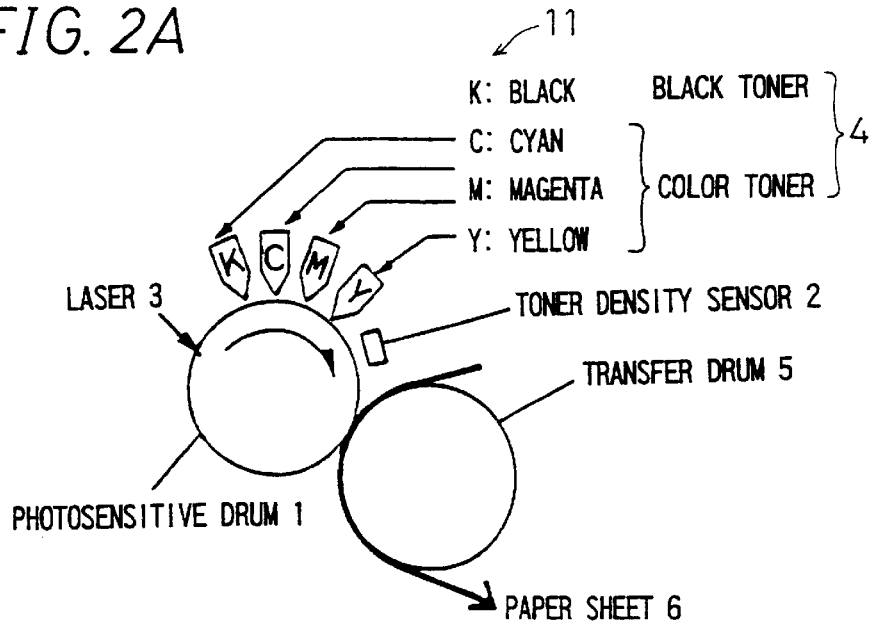
FIGS. 2A and 2B are diagrams illustrating the structure of the toner density sensor 2 of the embodiment and the image forming apparatus 1 employing the same.

FIG. 2A is a view illustrating an image forming apparatus 11 which employs the toner density sensor of the embodiment.

The image forming apparatus is composed of a photosensitive drum 1, a toner density sensor 2, a laser writing device 3, a development device 4, and a transfer drum 5.

The photosensitive drum 1, built as a cylindrical member having on its circumferential surface a photosensitive substance made of high molecular weight compounds, rotates in the direction indicated by the arrow. In the upper portion of the photosensitive drum 1 is disposed the laser writing device 3. The laser writing device 3 forms an electrostatic latent image by irradiating a laser beam toward the photosensitive drum 1. At a position downstream from the laser writing device 3 in the rotation direction is disposed the development device 4. The development device 4 accommodates black toner and color toner of cyan, magenta, and yellow colors, and discharges the toner through its discharge portion into the photosensitive drum 1. The toner discharged therefrom is attached to the surface of the photosensitive drum 1, and consequently the electrostatic latent image is visualized.

At a position downstream from the development device 4 is disposed the toner density sensor 2. The toner density sensor 2 is composed of the light-emitting diode LED1, the photodiode PD1, and the circuits that are shown in FIGS. 1A and 1B. In the toner density sensor 2, the light-emitting diode LED1 emits infrared light toward the photosensitive drum 1, and the light reflected from the toner attached to the photosensitive drum 1 is received by the photodiode PD1, whereby a certain voltage is outputted in accordance with the density of the toner. Toner density is detected based on the correlation between the output level of a voltage and the density of toner. At a position further downstream from the toner density sensor 2 and opposite to the photosensitive drum 1 is disposed the transfer drum 5 that rotates in the direction reverse to the rotation direction of the photosensitive drum 1. A transfer paper sheet 6 moves along the transfer drum 5, and a toner image formed on the circumferential surface of the photosensitive drum 1 is transferred onto the transfer paper sheet 6. The above-described process is individually performed for each toner and, as a result, a color image is formed on the paper sheet.

Figure 2B:
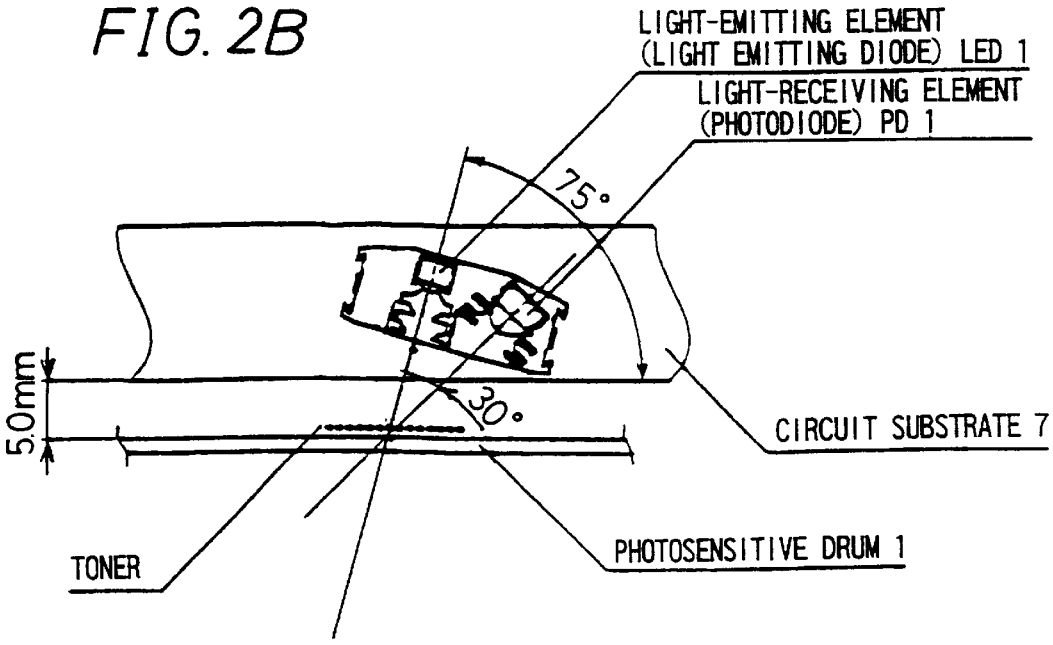

FIG. 2B is a view illustrating the structure of the toner density sensor 2.

The toner density sensor 2 is composed of a light-emitting diode LED1, a photodiode PD1, and a circuit substrate 7 including an I/V converting circuit and an amplifier circuit.

To detect the density of highly densed toner satisfactorily, the light-emitting diode LED1 and the photodiode PD1 are arranged at certain light-emitting and light-receiving angles, respectively, so as to be susceptible to diffuse reflection light from the toner. In this embodiment, the light-emitting diode LED1 is positioned at a light-emitting angle of 75° with respect to the surface of the photosensitive drum 1, and the photodiode PD1 is positioned at a light-receiving angle of 30° with respect to the surface of the photosensitive drum 1. This arrangement makes it possible to detect the density of even highly densed toner successfully without being affected by the influence of specular reflection light.

Figure 3A:
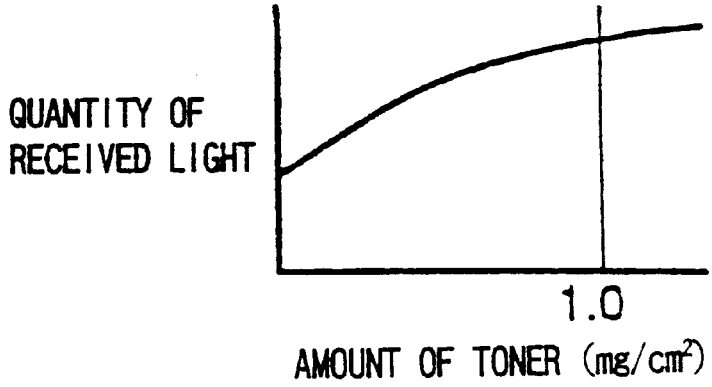
FIGS. 3A and 3B are graphs showing the relationship between the density of the color or black toner attached to the photosensitive drum 1 and the quantity of received light.
Figure 3B:
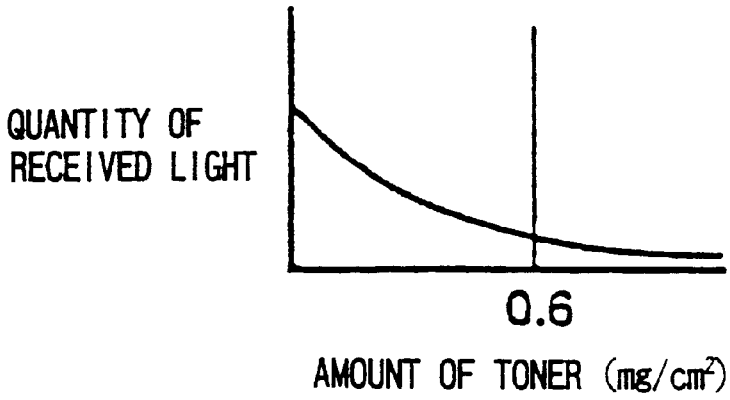

FIGS. 3A and 3B are graphs showing the relationship between the density of the color or black toner attached to the photosensitive drum 1 and the quantity of received light.

In a case where color toner is attached to the drum, the larger the amount of the toner, the larger the quantity of light received by the light-receiving element (see FIG. 3A). This is because the reflectance for infrared light of each toner of cyan, magenta, and yellow colors is greater than that of the surface of the photosensitive drum. When the amount of the color toner attached to the surface of the photosensitive drum is equal to or greater than the predetermined value (1.0 $mg/cm^2$ in the graph), the light-receiving element no longer receives the diffuse reflection light from the photosensitive drum, but receives only the diffuse reflection light from the color toner. Consequently, the quantity of received light is kept constant.

In a case where black toner is attached to the drum, the larger the amount of the toner, the smaller the quantity of light received by the light-receiving element (see FIG. 3B). This is because the reflectance for infrared light of the black toner is smaller than that of the surface of the photosensitive drum. When the amount of the black toner attached to the surface of the photosensitive drum is equal to or greater than the predetermined value (0.6 $mg/cm^2$ in the graph), the light-receiving element no longer receives the diffuse reflection light from the photosensitive drum, but receives only a slight quantity of the diffuse reflection light from the black toner. Consequently, the quantity of received light is almost zero and is kept constant.

Figure 4:
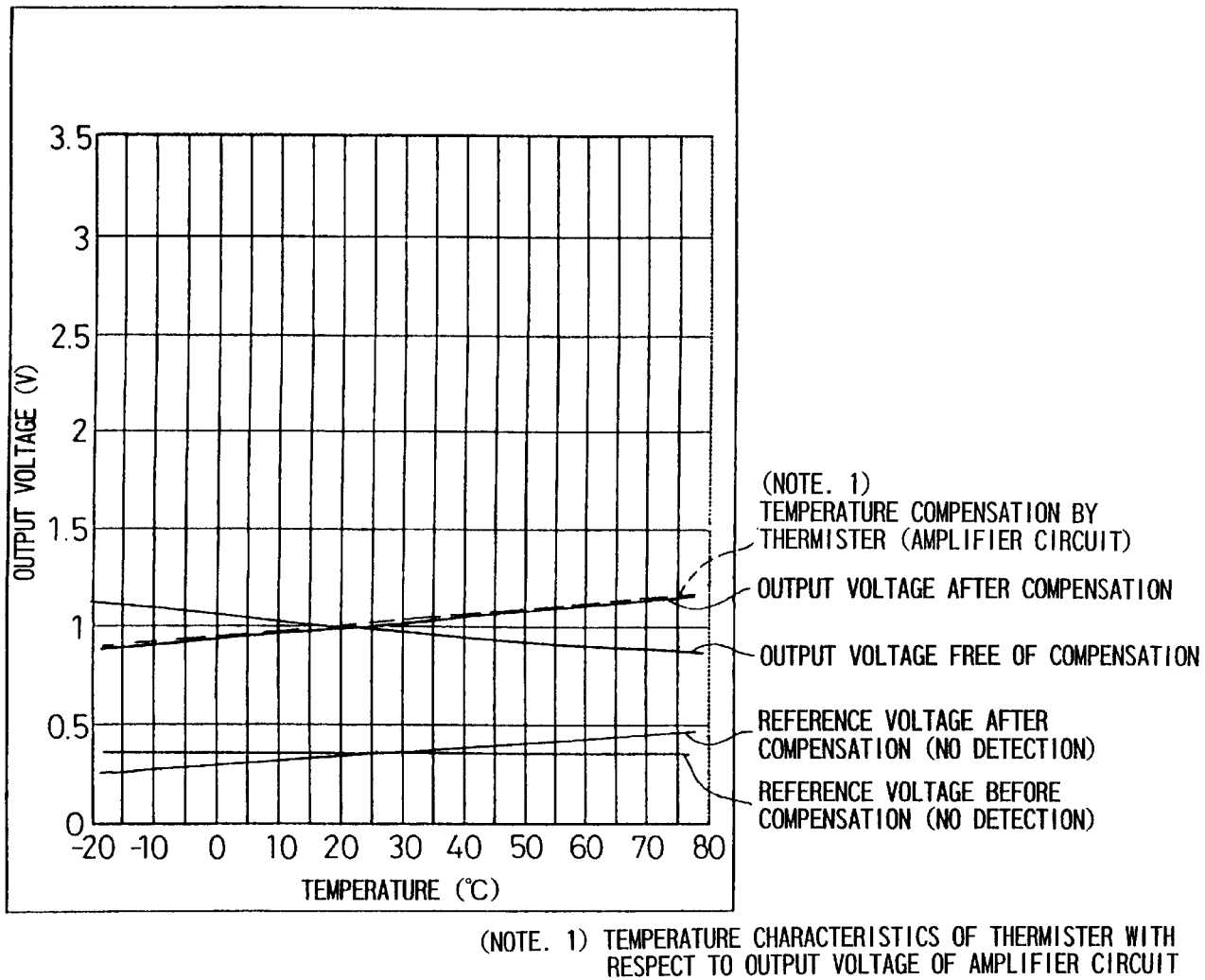
FIG. 4 is a graph showing the temperature characteristics of output voltages, as observed when density measurements are made with color toner.
Figure 5:
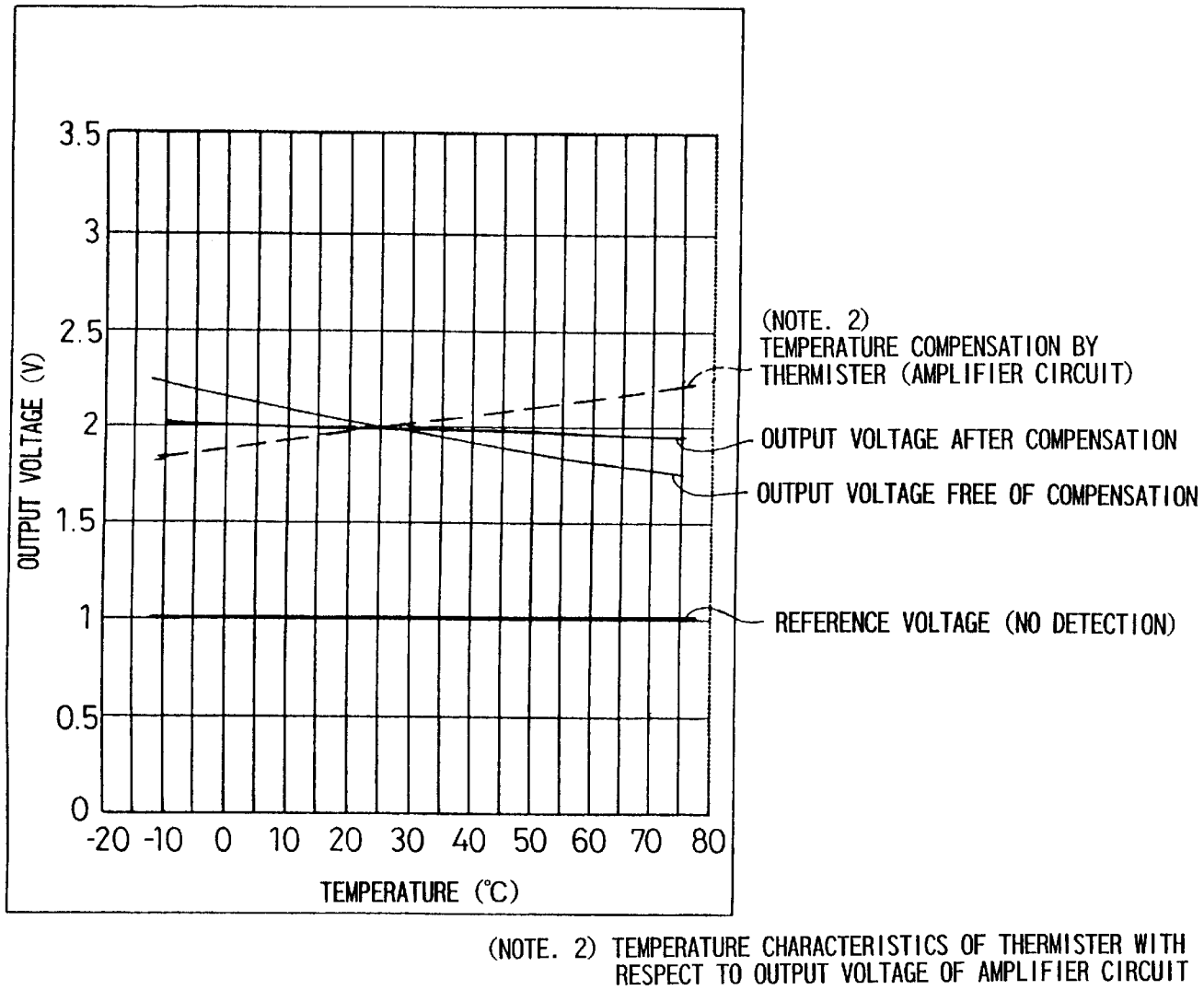
FIG. 5 is a graph showing the temperature characteristics of output voltages, as observed when density measurements are made with black toner.

FIG. 4 is a graph showing the temperature characteristics of output voltages as observed when color toner is subjected to density measurement, and FIG. 5 is a graph showing the temperature characteristics of output voltages as observed when black toner is subjected to density measurement.

To detect the density of toner in reality, the output voltage obtained when the light-emitting diode LED1 is in its deactivated state is detected in advance as a reference voltage. To detect the density of color toner, the reference voltage is set at Vref2+(Vref2−Vref1)·TH1/R2. To detect the density of black toner, the reference voltage is set at Vref1. The reference voltage can be set at any given value by varying the resistances 5, 6, and 7 of the partial voltage circuit of the light-emitting portion as shown in FIG. 1. Note that the reference voltage can seemingly be set at a negative value. This voltage, however, will not be actually outputted, because the embodiment employs 5V single power source.

After the detection of the voltage outputted from the light-receiving portion at the time when the light-emitting diode LED1 emits light, based on the voltage obtained by subtracting the reference voltage from the output voltage, the density of toner is detected. At this time, as described previously, because of the temperature characteristics of the light-emitting diode LED1 and the photodiode PD1, output voltages are high on the low-temperature side and are low on the high-temperature side.

As shown in FIG. 4, output voltages free of compensation (the primary output voltage) are 1.1V at −10° C. and 0.94 V at 50° C. On the other hand, the reference voltage free of compensation is 0.35 V and is kept constant in spite of the temperature change. Differences between the reference voltage and the output voltages, obtained by subtracting the reference voltage from the output voltages are 0.75 V at −10° C. and 0.59 V at 50° C., which vary with temperature.

In the toner density sensor of the embodiment, as shown in FIGS. 1A and 1B showing circuit diagrams, the amplifier circuit for detecting the color toner density includes a thermistor used to compensate for variation in output voltages due to the temperature change. Therefore, the compensated output voltages, as shown in FIG. 4, are 0.9 V at −10° C. and 1.08 V at 50° C., and the compensated reference voltages are 0.27 V at −10° C. and 0.4 V at 50° C. Differences between the reference voltages and the output voltages, obtained by subtracting the reference voltages from the output voltages, respectively, are 0.63 V at −10° C. and 0.68 V at 50° C., which are substantially kept constant in spite of the temperature change.

As shown in FIG. 5, the output voltage free of compensation (the primary output voltage) is 2.23 V at −10° C., but is decreased to 1.85 V at 50° C. On the other hand, the reference voltage free of compensation is 1.0 V and is kept constant in spite of the temperature change. Differences between the reference voltage and the output voltages, obtained by subtracting the reference voltage from the output voltages are 1.23 V at −10° C. and 0.85 V at 50° C., which vary with temperature.

In the toner density sensor of the embodiment, as shown in FIGS. 1A and 1B showing circuit diagrams, the amplifier circuit for detecting the black toner density includes a thermistor which is used to compensate for variation in output voltages due to a temperature change. Therefore, the compensated output voltage shown in FIG. 4 is 2.03 V at −10° C., but is decreased to 1.98 V at 50° C. The reference voltage is 1.0 V and is kept constant regardless of the temperature change. Accordingly differences between the reference voltage and the output voltages, obtained by subtracting the reference voltage from the output voltages are 1.03 V at −10° C. and 0.98 V at 50° C., which are substantially kept constant in spite of the temperature change.

As described heretofore, in the toner density sensor of the embodiment, output voltages are substantially kept constant and vary little with temperature. This makes it possible to detect toner density with sufficiently high accuracy.

Although the embodiment deals only with a sensor which employs a single light-receiving element for receiving diffuse reflection light, the present invention can be applied to the following sensor. The sensor is additionally provided with an I/V converting circuit composed of a photodiode PD2, a variable resistance VR2, a resistance R13, and an amplifier circuit IC3 that are enclosed within parentheses in FIGS. 1A and 1B showing circuit diagrams. In this structure, the photodiode PD2 is arranged at a certain angle so as to receive specular reflection light, and receives the infrared reflection light irradiated onto the transfer belt, whereby the density of the toner attached to the transfer belt is detected. This sensor also has compensation means provided in its amplifier circuit, and thus makes highly-accurate density detection possible without being affected by a temperature change.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner density sensor which detects density of toner attached to a photoconductor of an electrophotographic color image forming apparatus based on an output level in accordance with an amount of reflection light of irradiation light irradiated toward the photoconductor, the toner density sensor comprising:

a light-receiving element for receiving reflection light;

an amplifier circuit or amplifying output from the light-receiving element; and compensation means disposed in the amplifier circuit, for compensating for variation in output level due to a temperature change wherein the compensation means is composed of an input resistance in the amplifier circuit and a negative feedback resistance constituted by a thermistor.

2. The toner density sensor of claim 1, comprising:

an amplifier circuit for detecting color toner density; and an amplifier circuit for detecting black toner density, each of the amplifier circuits being provided with the compensation means.

* * * * *